US007437978B1

(12) United States Patent
Aldredge

(10) Patent No.: US 7,437,978 B1
(45) Date of Patent: Oct. 21, 2008

(54) SELF-ADJUSTING LOCKING VISE GRIP

(76) Inventor: Robert L. Aldredge, 7064 Salem Crossing Pl., Englewood, OH (US) 45322

( * ) Notice: Subject to any disclaimer, the term of this patent is extended or adjusted under 35 U.S.C. 154(b) by 0 days.

(21) Appl. No.: 11/843,272

(22) Filed: Aug. 22, 2007

(51) Int. Cl.
*B25B 7/12* (2006.01)

(52) U.S. Cl. ..... 81/367; 81/382

(58) Field of Classification Search ..... 81/367–384
See application file for complete search history.

(56) References Cited

U.S. PATENT DOCUMENTS 3,208,319 A 9/1965 Westby et al.
5,394,753 A * 3/1995 Moriyoshi ..... 73/818
5,733,073 A * 3/1998 Zitzlaff et al. ..... 407/107
6,776,072 B2 8/2004 Poole et al.
6,941,844 B2 * 9/2005 Hile ..... 81/368
2007/0180957 A1 * 8/2007 Johnson ..... 81/368

* cited by examiner

*Primary Examiner*—D. S Meislin
(74) *Attorney, Agent, or Firm*—Donald J. Ersler

(57) ABSTRACT

A self-adjusting locking vise grip includes a stationary handle, a stationary jaw, a pivoting jaw, a pivoting handle, a first link, a second link and a rail assembly. The stationary jaw is retained in one end of the stationary handle. The pivoting jaw is pivotally retained adjacent the stationary jaw. One end of the pivoting handle is pivotally retained on the pivoting jaw. The first link is pivotally retained by the pivoting handle. The second link is pivotally retained by the first link. The rail assembly includes a slide carriage, an adjustment screw and a rail member. The adjustment screw is threaded into the slide carriage. The slide carriage is slidably retained by the rail tube. The other end of the second link is pivotally retained by the slide carriage. The rail member is retained in the other end of the stationary handle.

16 Claims, 4 Drawing Sheets

SELF-ADJUSTING LOCKING VISE GRIP

BACKGROUND OF THE INVENTION

1. Field of the Invention

The present invention relates generally to gripping tools and more specifically to a self-adjusting locking vise grip, which does not need adjustment for clamping objects of different thicknesses.

2. Discussion of the Prior Art

U.S. Pat. No. 3,208,319 to Westby et al. discloses a self-adjusting wrench. The Westby et al. patent includes a handle integral with a stationary jaw. A moveable jaw pivoted retained in the handle. A pivoting handle pivotally retained by said moveable jaw. A travel block slidable on a rod, the rod is retained in the handle. A pair of links pivotally retained by the pivoting handle. A cam portion formed on an end of one of said pair of links. The cam portion engaging the rod. U.S. Pat. No. 6,776,072 to Poole et al. discloses an adjustable pliers wrench. The Poole et al. patent includes an adjustable pliers wrench including a fixture having a handle and an opposing stationary jaw, a co-acting jaw pivoted to the fixture and a lever pivoted to the co-acting jaw. A guide is attached proximate the handle and a locking element is arranged on the guide for reciprocal and canting movement.

Accordingly, there is a clearly felt need in the art for a self-adjusting locking vise grip, which does not need adjustment for clamping objects of different thicknesses, but does include a pressure adjustment.

SUMMARY OF THE INVENTION

The present invention provides a self-adjusting locking vise grip, which does not need adjustment for clamping objects of different thicknesses. The self-adjusting locking vise grip (vise grip) includes a stationary handle, a stationary jaw, a pivoting jaw, a pivoting handle, a first link, a second link and a rail assembly. The stationary jaw is rigidly retained in one end of the stationary handle. The pivoting jaw is pivotally retained in the one end of the stationary handle, adjacent the stationary jaw. One end of the pivoting handle is pivotally retained on the pivoting jaw. One end of the first link is pivotally retained in substantially the one end of the pivoting handle. One end of the second link is pivotally retained by the other end of the first link.

The rail assembly includes a slide carriage, an adjustment screw, a rail member, a compression spring and a retention block. The slide carriage includes a link yoke, a rail tube and a threaded boss. The threaded boss is formed on a perimeter of the rail tube. The link yoke extends from the rail tube. A female thread of the threaded boss is sized to threadably receive the adjustment screw. The rail tube is sized to receive a perimeter of the rail member. The rail member includes a T-shaped cross section extending from a round cross section. The T-shaped cross section is sized to receive the other end of the second link. The other end of the second link is pivotally retained in the link yoke. The compression spring is retained on the rail member. The round cross section of the rail member is retained in the retention block. The retention block is retained in the other end of the stationary handle.

Accordingly, it is an object of the present invention to provide a vise grip, which does not need adjustment for clamping objects of different thicknesses.

Finally, it is another object of the present invention to provide a vise grip, which includes a pressure adjustment.

These and additional objects, advantages, features and benefits of the present invention will become apparent from the following specification.

DETAILED DESCRIPTION OF THE PREFERRED EMBODIMENTS

Figure 1:
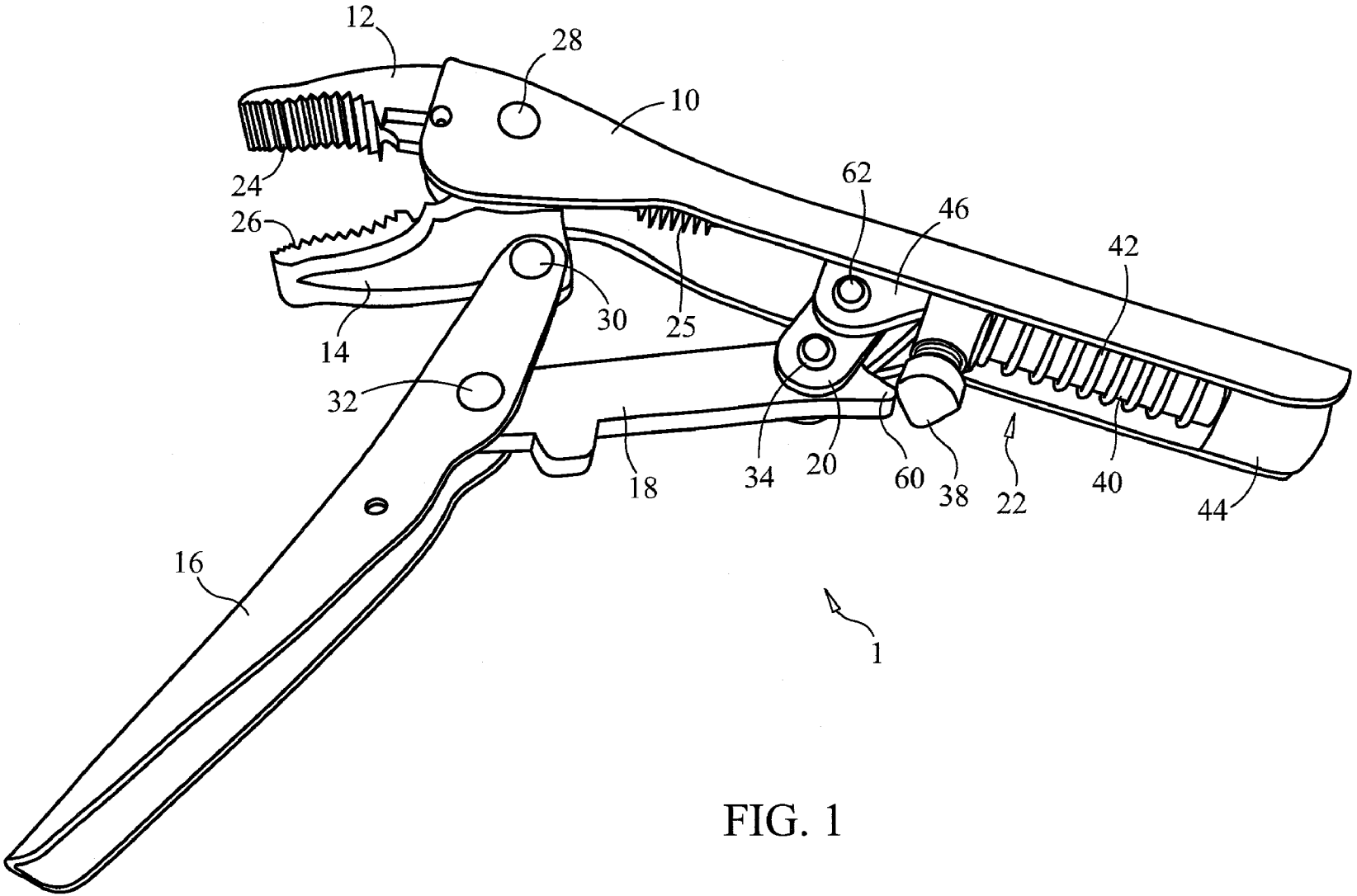
FIG. 1 is a bottom perspective view of an open vise grip in accordance with the present invention.
Figure 2:
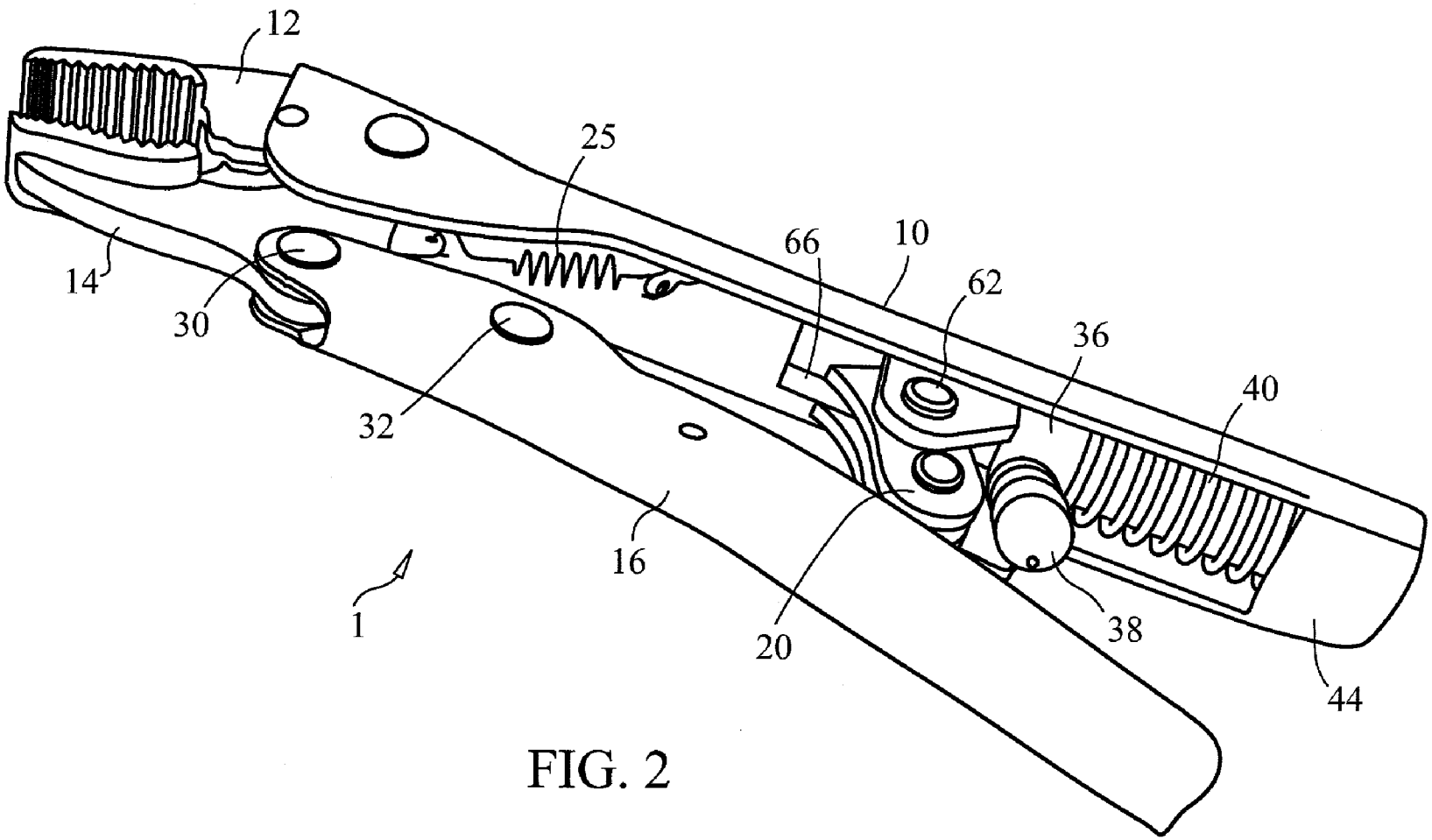
FIG. 2 is a bottom perspective view of a closed vise grip in accordance with the present invention.
Figure 3:
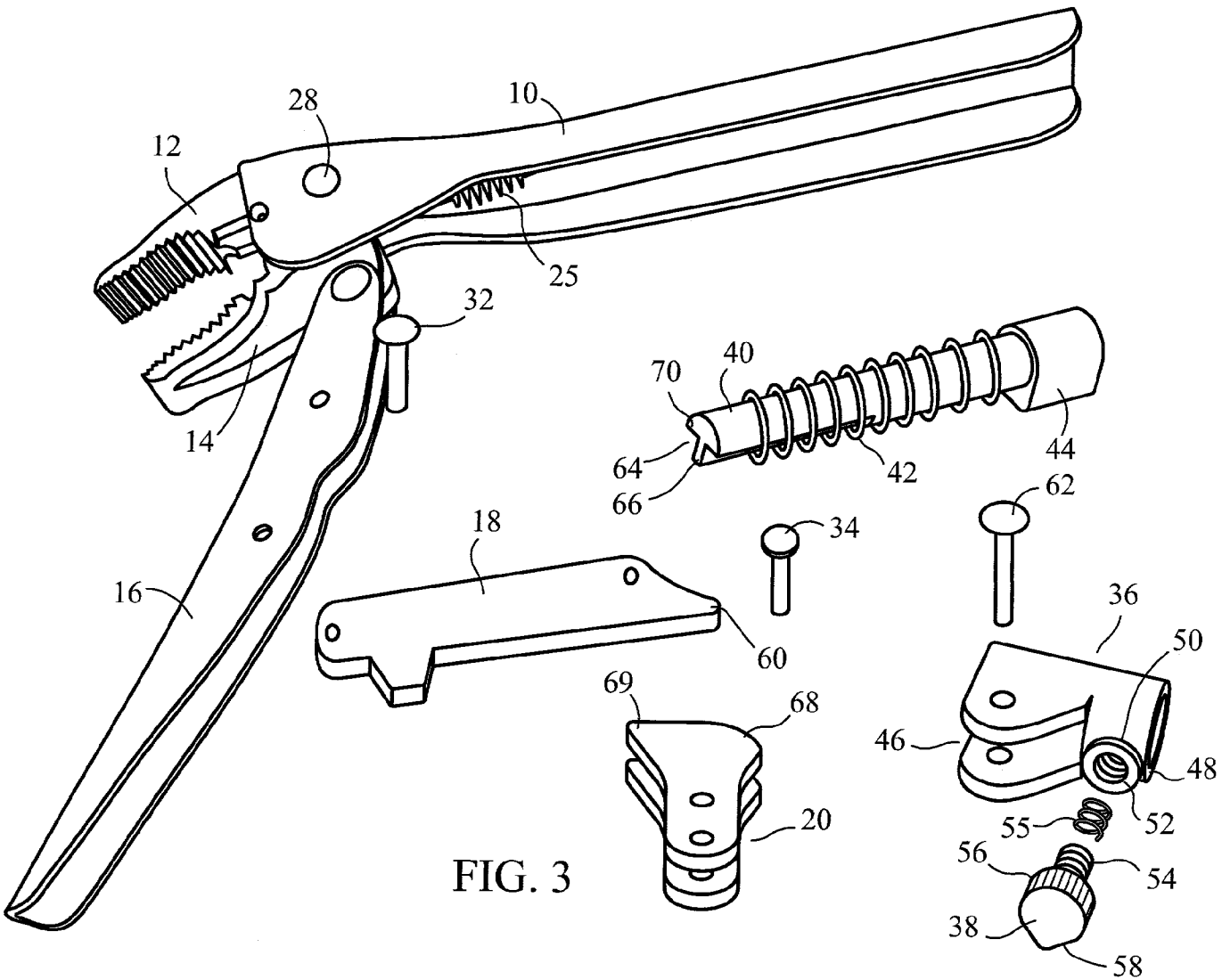
FIG. 3 is a partially exploded perspective view of an open vise grip in accordance with the present invention.

With reference now to the drawings, and particularly to FIG. 1, there is shown a perspective view of a vise grip 1. With reference to FIGS. 2-3, the vise grip 1 includes a stationary handle 10, a stationary jaw 12, a pivoting jaw 14, a pivoting handle 16, a first link 18, a second link 20 and a rail assembly 22. The stationary handle 10, the stationary jaw 12, the pivoting jaw 14 and the pivoting handle 16 are similar to those of other prior art vise grips. The stationary handle 10 includes a substantially U-shaped cross section. The stationary jaw 12 includes a stationary gripping surface 24 formed on one end. The other end of the stationary jaw 12 is rigidly retained in one end of the stationary handle 10 by welding or the like.

The pivoting jaw 14 includes a pivoting gripping surface 26 formed on one end. The other end of the pivoting jaw 14 is pivotally retained in the one end of the stationary handle 10 with a rivet 28, adjacent the other end of the stationary jaw 12. The vise grip 1 is preferably biased to be in an open position by connecting one end of an extension spring 25 to the other end of the pivoting jaw 14 and connecting the other end of the extension spring 25 to substantially a middle of the stationary handle 10. The pivoting handle 16 includes a substantially U-shaped cross section. One end of the pivoting handle 16 is pivotally retained on the other end of the pivoting jaw 14 with a rivet 30. One end of the first link 18 is pivotally retained in substantially the one end of the pivoting handle 16 with a rivet 32. One end of the second link 20 is pivotally retained on the other end of the first link 18 with a rivet 34. The second link 20 may be two link members or the two link members may be joined by a web area (not shown), such that the second link 20 is fabricated from a single piece of material.

The rail assembly 22 preferably includes a slide carriage 36, an adjustment screw 38, a rail member 40, a compression spring 42 and a retention block 44. The slide carriage 36 includes a link yoke 46, a rail tube 48 and a threaded boss 50. The threaded boss 50 is formed on a perimeter of the rail tube 48. The link yoke 46 extends from the rail tube 48. A female thread 52 of the threaded boss 50 is sized to threadably receive a threaded portion 54 of the adjustment screw 38. An inner perimeter of the rail tube 48 is sized to slidably receive an outer perimeter of the rail member 40. The rail member 40 is first inserted through the rail tube 48, before insertion of a screw compression spring 55 into the female thread 52. The threaded portion 54 of the adjustment screw 38 is then threaded into the female thread 52.

A gripping perimeter 56 is formed on a perimeter of the adjustment screw 38 to facilitate turning of the adjustment screw 38 with a finger and thumb. A cone shape 58 is formed on an end of the adjustment screw 38 for contact with a pressure projection 60 extending from a second end of the first link 18. Substantially the other end of the second link 20 is pivotally retained in the link yoke 46 with a rivet 62. The rail member 40 includes a T-shaped cross section 64 extending from a round cross section. An extension leg 66 of the T-shaped cross section 64 is sized to receive the other end of the second link 20.

A cam surface 68 is formed on the other end of the second link 20 to physically engage a pair of flats 70 of the T-shaped cross section 64 during operation of the vise grip. The cam surface 68 preferably includes a flat extension 69. The flat extension 69 prevents the second link 20 from rolling backwards, when the vise grip 1 is fully opened. The compression spring 42 is retained on the rail member 40. The round cross section of the rail member is retained in the retention block 44 with a press fit or the like. The retention block 44 is retained in the other end of the stationary handle 10 with welding or the like.

Figure 4:
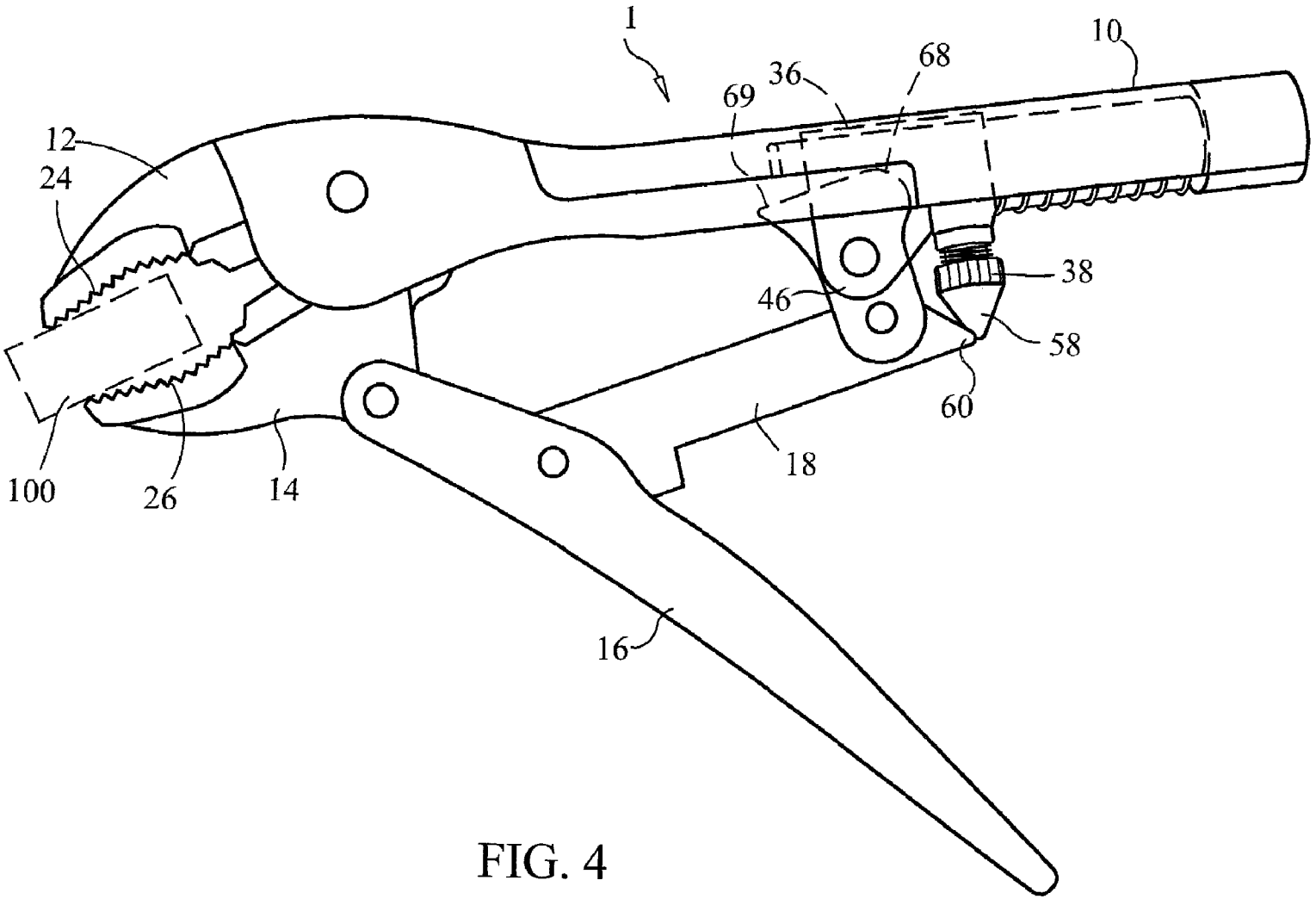
FIG. 4 is a side view of a partially open vise grip gripping an object in accordance with the present invention.

With reference to FIG. 4, when the pivoting handle 16 is at about a 45 degree angle to the stationary handle 10 the pressure projection 60 contacts the cone shape 58 of the adjustment screw 38. As the vise grip 1 is closed, the pressure projection 60 moves away from the cone shape 58 and the cam surfaces 68 engages the pair of flats 70 of the T-shaped cross section 64. The cam surface 68 engagement with the pair of flats 70 causes the stationary and pivoting gripping surfaces to clamp on an object 100. The height of the adjusting screw 38 determines when the engagement between the pressure projection 60 and the cone shape 58 of the adjustment screw stops and the engagement between the cam surface 68 and the pair of flats 70 starts.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A self-adjusting locking vise grip comprising:

a stationary jaw extending from one end of a stationary handle;

a pivoting jaw being pivotally retained adjacent said stationary jaw;

a pivoting handle being pivotally engaged with said pivoting jaw;

a slide carriage being slidably retained by the other end of said stationary handle;

an adjustment screw being threadably engaged with said slide carriage; and a first link having one end pivotally engaged with said pivoting handle, the other end of said first link being pivotally engaged with one end of a second link, the other end of said second link being pivotally engaged with said slide carriage, the other end of said first link contacting said adjustment screw during operation of said self-adjusting locking vise grip.

2. The self-adjusting locking vise grip of claim 1, further comprising:

a rail member being retained in the other end of said stationary handle, said slide carriage being slidably engaged with said rail member.

3. The self-adjusting locking vise grip of claim 2, further comprising:

a cam surface being formed on the other end of said second link, said cam surface contacting said rail member during operation of said self-adjusting locking vise grip.

4. The self-adjusting locking vise grip of claim 1, wherein:

a cone shape being formed on one end of said adjustment screw.

5. The self-adjusting locking vise grip of claim 2, further comprising:

a compression spring being retained on said rail member, said compression spring biasing said slide carriage toward said stationary jaw.

6. The self-adjusting locking vise grip of claim 1, further comprising:

an extension spring having one end engaged with said pivoting jaw and the other end engaged with said stationary handle.

7. A self-adjusting locking vise grip comprising:

a stationary jaw extending from one end of a stationary handle;

a pivoting jaw being pivotally retained adjacent said stationary jaw;

a pivoting handle being pivotally engaged with said pivoting jaw;

a slide carriage being slidably retained on a rail member, said rail member being retained by said stationary handle;

an adjustment screw being threadably engaged with said slide carriage; and a first link having one end pivotally engaged with said pivoting handle, the other end of said first link being pivotally engaged with one end of a second link, the other end of said second link being pivotally engaged with said slide carriage, the other end of said first link contacting said adjustment screw during operation of said self-adjusting locking vise grip.

8. The self-adjusting locking vise grip of claim 7, wherein:

a cone shape being formed on one end of said adjustment screw.

9. The self-adjusting locking vise grip of claim 7, further comprising:

a cam surface being formed on the other end of said second link, said cam surface contacting said rail member during operation of said self-adjusting locking vise grip.

10. The self-adjusting locking vise grip of claim 7, further comprising:

a compression spring being retained on said rail member, said compression spring biasing said slide carriage toward said stationary jaw.

11. The self-adjusting locking vise grip of claim 7, further comprising:

an extension spring having one end engaged with said pivoting jaw and the other end engaged with said stationary handle.

12. A self-adjusting locking vise grip comprising:

a stationary jaw extending from one end of a stationary handle;

a pivoting jaw being pivotally retained adjacent said stationary jaw;

a pivoting handle being pivotally engaged with said pivoting jaw;

a slide carriage being slidably retained by the other end of said stationary handle;

an adjustment screw being threadably engaged with said slide carriage; and a first link having one end pivotally engaged with said pivoting handle, the other end of said first link being pivotally engaged with one end of a second link, the other end of said second link being pivotally engaged with said slide carriage, the other end of said first link contacting said adjustment screw during operation of said self-adjusting locking vise grip, a cam surface being formed on the other end of said second link, said cam surface contacting said rail member.

13. The self-adjusting locking vise grip of claim 12, wherein:

a cone shape being formed on one end of said adjustment screw.

14. The self-adjusting locking vise grip of claim 12, further comprising:

a rail member being retained in the other end of said stationary handle, said slide carriage being slidably engaged with said rail member.

15. The self-adjusting locking vise grip of claim 12, further comprising:

a compression spring being retained on said rail member, said compression spring biasing said slide carriage toward said stationary jaw.

16. The self-adjusting locking vise grip of claim 12, further comprising:

an extension spring having one end engaged with said pivoting jaw and the other end engaged with said stationary handle.

* * * * *